United States Patent [19]

Steinort

[11] Patent Number: 4,676,154

[45] Date of Patent: Jun. 30, 1987

[54] METHOD OF DISCHARGING A WASH OR LAUNDRY PRESS

[75] Inventor: Hans Steinort, Hildesheim, Fed. Rep. of Germany

[73] Assignee: Senkingwerk GmbH, Hildesheim, Fed. Rep. of Germany

[21] Appl. No.: 727,801

[22] Filed: Apr. 26, 1985

[30] Foreign Application Priority Data

Apr. 28, 1984 [DE] Fed. Rep. of Germany ..... 3415856

[51] Int. Cl.[4] ..... D06F 47/06

[52] U.S. Cl. ..... 100/37; 68/242; 100/116; 100/211

[58] Field of Search ..... 68/21, 241, 242; 100/37, 116, 125, 211

[56] References Cited

FOREIGN PATENT DOCUMENTS 60420 9/1982 European Pat. Off. ..... 68/242
2602845 7/1976 Fed. Rep. of Germany .
2852923 6/1980 Fed. Rep. of Germany .

*Primary Examiner*—Philip R. Coe
*Attorney, Agent, or Firm*—Karl F. Ross; Herbert Dubno

[57] ABSTRACT

The press container of a wash press sits on a porous press plate. Because of the high press pressure of the press piston head the fabrics of the wash are partially forced into the holes of the press plate. In order to remove the pressed wash safely from the press plate, the pressed wash is raised somewhat from the press plate when the press container and press piston are simultaneously raised, first into a middle position in which the press piston head remains, while the press container is raised further. The wash loosened in this way can be safely slid laterally from the press plate.

6 Claims, 3 Drawing Figures

METHOD OF DISCHARGING A WASH OR LAUNDRY PRESS

FIELD OF THE INVENTION

My present invention relates to a process for the removal of pressed wash or laundry from the press container of a wash press.

BACKGROUND OF THE INVENTION

To press wet wash to remove water from it (press extraction) and partially therefore to dry it, prior art pressing processes can use a press having a bell-shaped diaphragm positioned on top of the wash and driven by means of a pressurizing medium In German patent DE-PS No. 28 52 923 one such press with a diaphragm and a filling frame lowerable into a press body is described.

After raising of the diaphragm support and of the filling frame the pressed wash lies compacted on the porous press plate and can be moved from the pressing location by sliding laterally.

With the high press pressure however it is unavoidable that some of the fabric projects somewhat into and is firmly in the holes of the press plate and therefore damage can occur to the fabric sliding the wash from the press plate.

Similar problems can occur when a press piston is changed as is described in German patent DE-OS No. 26 02 845. Also in this case the pressed wash lies on the press plate after pressing and first the press holder and subsequently the press piston head are raised.

OBJECTS OF THE INVENTION

It is an object of my invention to provide an improved process for removing pressed wash from a wash press.

It is also an object of my invention to provide an improved process for removing wash from a wash press which reduces damage to the pressed wash.

It is a further object of my invention to provide an improved process for removing pressed wash from a wash press in which fabrics washed are not caught in the holes of the porous surfaces therein and subsequently damaged.

Another object is to provide an improved apparatus for carrying out the invention.

My invention is based on a desire to provide an improved process for pressing wash for partial drying thereof in a wash press in which the wash may be safely removed from the wash press without damage thereto and fed into the subsequent station, e.g. a tumble drier.

SUMMARY OF THE INVENTION

These objects and others which will become apparent hereinafter are attained in accordance with my invention in a process for the removal of pressed wash from the extraction press container of a wash press comprising sliding the pressed wash from the press plate or base plate of the wash press, after raising the press piston head therefrom.

According to my invention after pressing the wash to partially remove water therefrom, by simultaneously raising the press container and a press piston head, the pressed wash is lifted at least in part with the press container up from the porous press plate and raised into a middle position. In this middle position the press piston is held in place, preferably under hydraulic control, while the press container is raised further to a final position so that the pressed wash is ejected. The pressed wash is then removed from the press plate and the press container and press piston head are returned to their initial starting position.

Thus the pressed wash is raised in the above-described manner from the holes in the press plate so that a safe release and subsequenly a sidewise sliding away of the released wash cake on the press plate is possible.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figure 1:
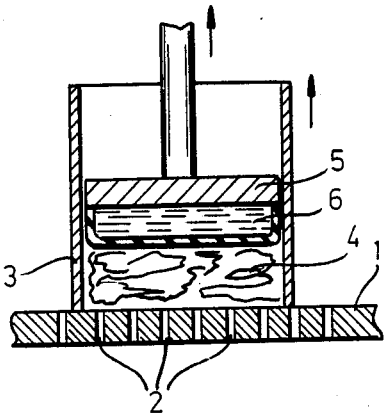
FIG. 1 is a schematic vertical cross section of a wash press and wash showing the position of the press piston and the press container at the end of the pressing step.
Figure 3:
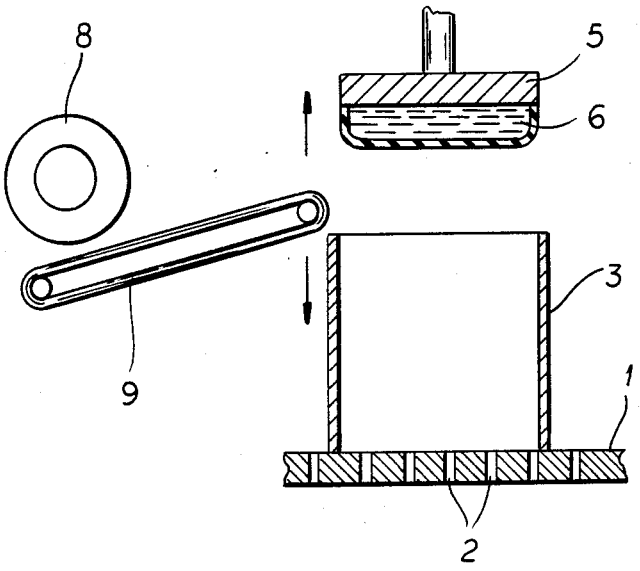
FIG. 3 is a schematic vertical cross section of a wash press and pressed wash showing the press piston and the press container in its initial starting position before pressing the next wash batch.

The cylindrical, nonperforated shell forming the press container 3 sits on the press plate 1 having holes 2 for draining the water from the pressed wash in the extraction press as shown in FIG. 3. After the wash 4 from the washing machine 8 associated with the press is filled into the press container 3 via a conveyor 9, the hydraulic driven press piston head 5 with an elastic covering 6, for example a water filled cushion, is lowered and the water is supplied via a pump 10 and a valve 11 to the cushion. This presses the wash by a pressure of about 30 bar. FIG. 1 shows the position at the end of such a press cycle or pressing process. The water is extracted through the holes 2.

Thereupon removal of the wash cake from the press plate 1 without damage to the wash fabrics occurs according to the invention.

The press piston head 5 and the press container 3 are raised in the same direction as both arrows shown in FIG. 1.

This is effected by the synchronous operation of the hydraulic jack actuators 7 and 12 under the control of a unit 13 forming a sequencing controller. The latter unit can include timing cams operating hydraulic valves, a microprocessor or any other conventional sequence controller.

The wash cake is therefore carefully lifted from the press plate 1 in a direction opposite the press direction.

Figure 2:
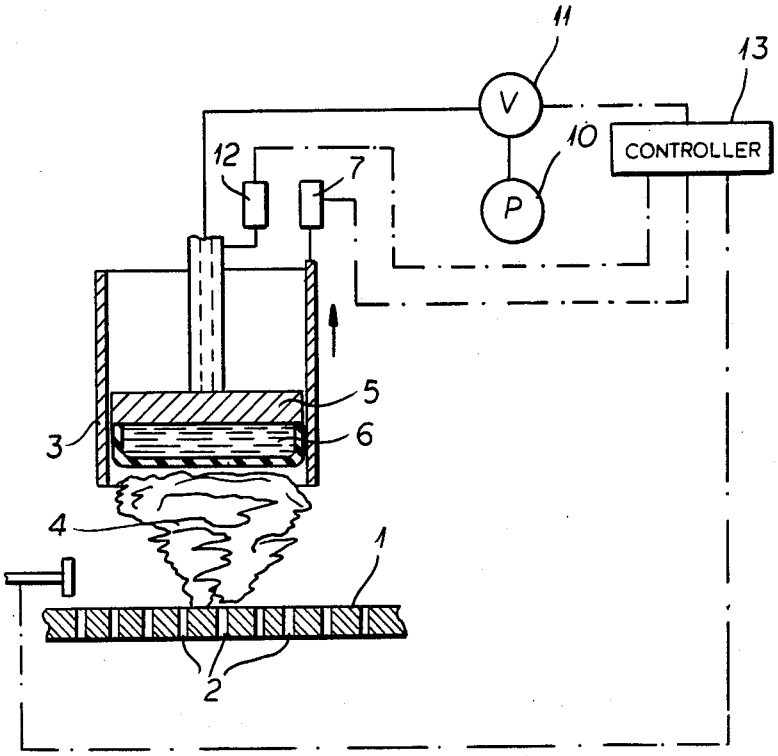
FIG. 2 is a schematic vertical cross section of a wash press and pressed wash at the time of ejection of the wash from the press container.

As soon as the press piston head 5 in its upward motion reaches a middle or intermediate position (FIG. 2), it is held in place by the control device 12, 13 hydraulically, while the press container 3 is raised further to its end or final position (FIG. 3).

The drive 7 operating the press container 3 is only symbolically indicated.

As a result the wash or laundry cakes are pushed out of the press container, fall down loosely onto the porous press plate 1 and can be pushed off of it safely by a laterally moving slider 14 operated by the controller.

Subsequently the press piston head 5 and the press holder 3 again move to their initial starting positions (i.e. the holder 3 is operated and the head 5 is raised (FIG. 3) and the wash press filling can occur again.

We claim:

1. In a process for removal of pressed wash from a press container of a wash press, the improvement wherein:

after pressing said wash against a perforated press plate to remove water therefrom, by simultaneously raising said press container and a press piston head, said pressed wash is carried with said press container up from the press plate of said wash press and raised into a middle position; in the middle position to eject said pressed wash, said press piston head is held in place, while said press container is raised into a final position to release said wash; and after removal of the released pressed wash from said press plate both said press piston head and said press container are brought to an initial starting position.

2. The improvement defined in claim 1 wherein said press piston head is held in said middle position under hydraulic control.

3. A method of extracting laundry comprising the steps of:

(a) lowering a press container into a starting position wherein said container rests upon a perforated press plate and a pressing head is spaced above an upper end of said container in its starting position;

(b) introducing a mass of wet laundry into said container;

(c) lowering said head into said container and pressing said mass of laundry therein to form a cake partly penetrating into perforations of said plate;

(d) simultaneously raising said container and said head into an intermediate position to lift said cake from said plate and withdraw laundry from said perforations;

(e) thereafter holding said head against further upward movement and raising said container to dislodge the lifted cake from said container onto said plate;

(f) displacing the laundry dislodged onto said plate from beneath said container; and (g) raising said head and lowering said container and then repeating steps (a) to (g).

4. The method defined in claim 3 wherein said head is held hydraulically in step (e).

5. An apparatus for extracting laundry which comprises;

a perforated plate;

a press container adapted to rest upon said plate;

a press head receivable in said container;

first means for raising and lowering said head relative to said plate and to said container;

second means for raising and lowering said container relative to said plate; and control means connected to said first and second means and programmed for sequentially:

(a) lowering said press container into a starting position wherein said container rests upon said plate and said head is spaced above an upper end of said container so that a mass of laundry can be introduced into said container;

(b) lowering said head into said container and pressing said mass of laundry therein to form a cake partly penetrating into perforations of said plate;

(c) simultaneously raising said container and said head into an intermediate position to lift said cake from said plate and withdraw laundry from said perforations;

(d) thereafter holding said head against further upward movement and raising said container to dislodge the lifted cake from said container onto said plate;

(e) displacing the laundry dislodged onto said plate from beneath said container; and (f) raising said head and lowering said container and then repeating steps (a) to (f).

6. The apparatus defined in claim 5 wherein said means for raising and lowering said head include hydraulic means.

* * * * *